US011609063B1

(12) United States Patent
Wei

(10) Patent No.: US 11,609,063 B1
(45) Date of Patent: Mar. 21, 2023

(54) TOY GUN WITH PRESSURE DIVERTER

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 17/685,334

(22) Filed: Mar. 2, 2022

(51) Int. Cl.

| | |
|---|---|
| ***F41B 11/89*** | (2013.01) |
| ***F41B 11/721*** | (2013.01) |
| ***F41B 11/62*** | (2013.01) |
| ***F41B 11/64*** | (2013.01) |

(52) U.S. Cl.
CPC ..... *F41B 11/721* (2013.01); *F41B 11/62* (2013.01); *F41B 11/64* (2013.01); *F41B 11/89* (2013.01)

(58) Field of Classification Search
CPC ..... F41A 21/10; F41A 11/02; F41A 21/484; F41B 11/62; F41B 11/64; F41B 11/89; F41B 11/52; F41B 11/55; F41B 11/721; F41B 11/54; F41B 11/722; F41B 11/723
USPC ..... 124/73, 41.1, 45, 49, 63, 71, 72, 74, 76, 124/82, 75, 77
See application file for complete search history.

(56) References Cited

U.S. PATENT DOCUMENTS

| | | | | |
|---|---|---|---|---|
| 7,469,624 | B1 * | 12/2008 | Adams | F41A 5/26 89/193 |
| 9,816,769 | B1 * | 11/2017 | Brown | F41A 5/28 |
| 10,690,438 | B1 * | 6/2020 | Wei | F41B 11/54 |
| 10,712,120 | B1 * | 7/2020 | Wei | F41B 11/89 |
| 11,204,218 | B1 * | 12/2021 | Wei | F41B 11/89 |
| 2008/0105245 | A1 * | 5/2008 | Cole | F41B 11/62 124/77 |
| 2017/0089652 | A1 * | 3/2017 | Ricks | F41A 5/28 |
| 2018/0156566 | A1 * | 6/2018 | Wei | F41B 11/70 |
| 2021/0389079 | A1 * | 12/2021 | Wei | F41B 11/89 |

* cited by examiner

*Primary Examiner* — Michael D David
(74) *Attorney, Agent, or Firm* — Chun-Ming Shih; HDLS IPR Services

(57) ABSTRACT

A toy gun includes a gun body, an action assembly, and a pressure diverter. The gun body includes a barrel and a gas flow conduit. The action assembly is installed on the gun body and includes a piston. The pressure diverter is received in the gun body and arranged between the barrel, the gas flow conduit, and the piston. The gas diverter includes a gas collection cavity and an inlet hole, a first outlet hole and a second outlet hole communicating to the gas collection cavity. The inlet hole is arranged corresponding to the gas flow conduit, the first outlet hole is arranged corresponding to the barrel, the second outlet hole is arranged corresponding to the piston. The cross-sectional area of the first outlet hole is greater than that of the second outlet hole.

10 Claims, 8 Drawing Sheets

TOY GUN WITH PRESSURE DIVERTER

BACKGROUND

Technical Field

The technical field of the present disclosure relates to a toy gun, and in particular, to a toy gun with a pressure diverter.

Description of Related Art

The related-art toy guns mostly include a firing pin disposed on the gas valve area of the pressure cylinder in the air gun, such that after the trigger of the gun body is pressed, it is able to drive the hammer to strike the firing pin, and the firing pin further strikes the gas valve. Once the gas valve of the pressure cylinder is knocked open by the firing pin, the gas inside the gas cylinder is released to shoot the bullet out as being used for the driving source of firing the bullet.

In addition, a gas diverter valve is typically installed between the barrel and the piston of the toy gun, allowing a portion of the gas to be used for firing the bullet and another portion of the gas to push the piston. The piston then further drives the hammer to lease the firing pin in order to prepare for the next firing shot.

However, the internal of the aforementioned gas diverter valve is equipped with a spring, and the airflow direction is controlled via the pressure force, such that a portion of the pressure is consumed by the spring. In addition, since the gas diverter valve has a greater number of component parts, it is likely to cause the drawbacks of gas diverter valve consuming a greater amount of pressure, complicated component parts and assembly process as well as high cost.

In view of the above, the inventor seeks to overcome the aforementioned drawbacks associated with the current technology and aims to provide an effective solution through extensive researches along with utilization of academic principles and knowledge.

SUMMARY OF PRESENT DISCLOSURE

The present disclosure provides a toy gun with a pressure diverter, and the pressure diverter only uses a first outlet hole and a second outlet hole for divergence, such that the pressure diverter is able to achieve the merits of easy control of gas flow, less consumption of pressure, simple structure, facilitated assembly and low cost.

In an exemplary embodiment, the preset invention provides a toy gun with pressure diverter having: a gun body having a barrel and a gas flow conduit arranged inside; an action assembly installed on the gun body and having a piston; and a pressure diverter received in the gun body and arranged between the barrel, the gas flow conduit and the piston; the gas diverter having a gas collection cavity and an inlet hole, a first outlet hole and at least one second outlet hole communicating to the gas collection cavity; the inlet hole arranged corresponding to the gas flow conduit, the first outlet hole arranged corresponding to the barrel, the at least one second outlet hole arranged corresponding to the piston, and a cross sectional area of the first outlet hole being greater than a cross sectional area of the at least one second outlet hole.

In view of the above, as the cross-sectional area of the first outlet hole is greater than the cross-sectional area of the second outlet hole, it is able to control the outlet volume flowing to the barrel to be greater than the outlet volume flowing to the piston. Accordingly, most of the gas volume may be used for firing the bullet to achieve the advantageous effect of excellent gas flow divergence via the pressure diverter.

DETAILED DESCRIPTION

Figure 1:
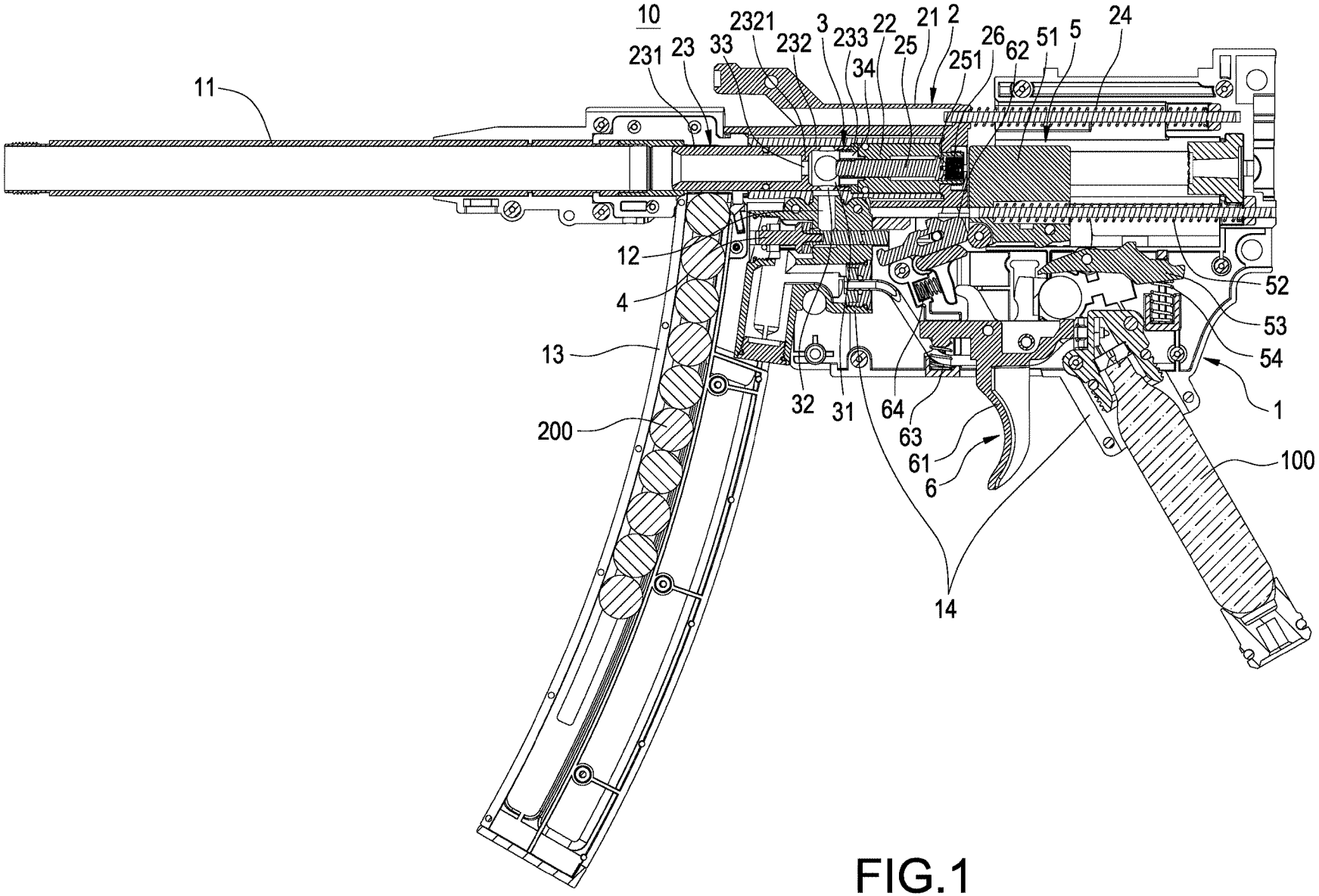
FIG. 1 is an assembly view of the toy gun of the present disclosure.
Figure 2:
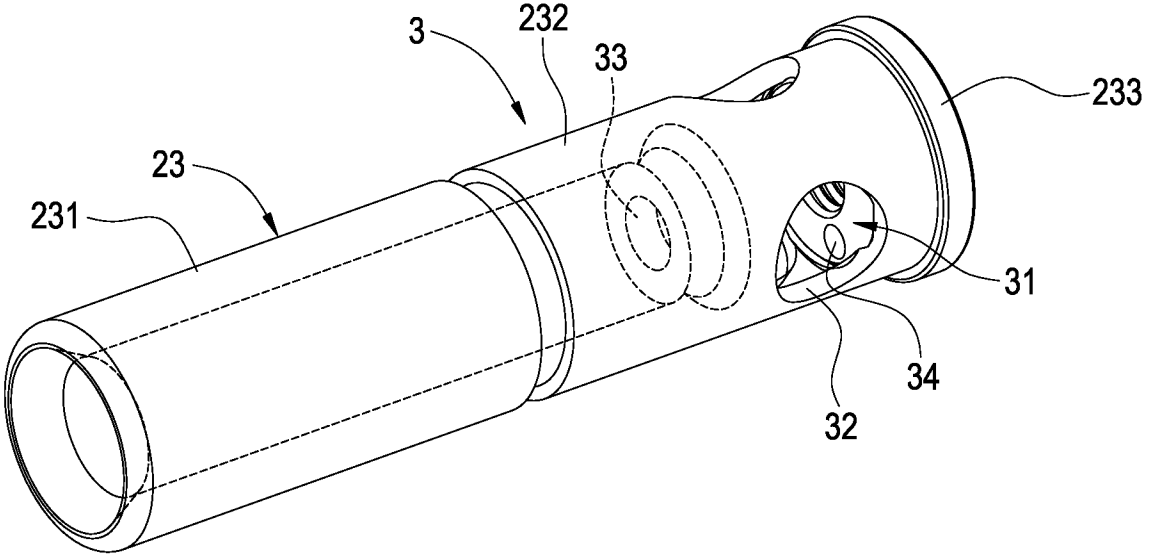
FIG. 2 is a perspective view of the pressure diverter of the present disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIG. 1 to FIG. 8. The present disclosure provides a toy gun with a pressure diverter. The toy gun 10 mainly includes a gun body 1, an action assembly 2 and a pressure diverter 3.

As shown in FIG. 1 and FIG. 3 to FIG. 8, the internal of the gun body 1 includes a barrel 11, a gas flow conduit 12, a magazine 13 and a gas chamber 14. The magazine 13 is used for placing the bullet 200 and communicates to the barrel 11. The gas chamber 14 is used for placing the gas cylinder 100 and communicates to the gas flow conduit 12.

As shown in FIG. 1 and FIG. 3 to FIG. 8, the action assembly 2 is installed on the gun body 1. The action assembly includes an action 21, a piston 22, a bullet feeding tube 23 and a first restoring spring 24. The action 21 is exposed at the external of the gun body 1 and is able to move horizontally forward and backward relative to the barrel 1. The piston 22 is received at the internal of the gun body 1 and is secured to the action 21 for the piston 22 to move along with the gun body 1. The bullet feeding tube 23 abuts against one end of the barrel 11 and is arranged between the barrel 11 and the magazine 13. In addition, the first restoring spring 24 is clamped between the gun body 1 and the action 21 and drives the action 21 to move forward and backward.

As shown in FIG. 1 to FIG. 8, the pressure diverter 3 is received at the internal of the gun body 1 and is arranged between the barrel 11, the gas flow conduit 12 and the piston 22. The internal of the pressure diverter 3 includes a gas collection cavity 31 and an inlet hole 32, a first outlet hole 33 and one or a plurality of second outlet hole 34. The inlet hole 32, the first outlet hole 33 and the second outlet hole 34 communicate to the gas collection cavity 31. The inlet hole 33 is arranged corresponding to the gas flow conduit 12, the first outlet hole 33 is arranged corresponding to the barrel 11, the second outlet hole 34 is arranged corresponding to the piston 22, and the cross-sectional area of the first outlet hole 33 is greater than the cross-sectional area of the second outlet hole 34.

The following provides further description in detail. The pressure diverter 3 is attached to the bullet feeding tube 23. The bullet feeding tube 23 is a hollow tubular member 231. The pressure diverter 3 includes an extension tube 232 extended from one end of the hollow tubular member 231 away from the barrel 11 and a sealing cap 233 covering and sealing the extension tube 232. An isolation plate 2321 is extended from an intersection between an inner wall of the extension tube 232 and the hollow tubular member 231. The inlet hole 32 is defined on the extension tube 232, the first outlet hole 33 is defined on the isolation plate 2321, and the second outlet hole 34 is defined on the sealing cap 233.

In addition, the action assembly further includes a connecting shaft 25 and a second restoring spring 26. One end of the connecting shaft 25 is secured to an external of the sealing cap 233 and another end of the connecting shaft 24 movably penetrates into the piston 22. The connecting shaft 24 includes a blocker 251 extended from another end thereof to mutually block with the piston 22. The second restoring spring 26 is clamped between the piston 22 and the connecting shaft 25.

Furthermore, the quantity of the second outlet hole 34 of the present exemplary embodiment is multiple. However, the present disclosure is not limited to such configuration only. The connecting shaft 25 is located at a middle portion of the sealing cap 233. The plurality of second outlet holes 34 are circumferentially and equidistantly arranged at a perimeter of the connecting shaft 25, and a cross sectional area of the first outlet hole 33 is greater than the sum of the cross-sectional areas of the plurality of second outlet holes 34.

As shown in FIG. 1 and FIG. 3 to FIG. 8, the toy gun 10 of the present disclosure further includes a switch valve 4. The switch valve 4 is installed between the gas flow conduit 12 and the gas chamber 14. The switch valve 4 is used for closing or opening the gas chamber 14.

As shown in FIG. 1 and FIG. 3 to FIG. 8, the toy gun 10 of the present disclosure further includes a hammer assembly 5. The hammer assembly 5 is received at the internal of the gun body 1. The hammer assembly 5 includes a hammer 51 and a third restoring spring 52. The hammer 51 is arranged corresponding to the piston 22 and is able to move horizontally forward and backward relative to the piston 22. The third restoring spring 52 is clamped between the gun body 1 and the hammer 51, and drives the hammer 51 to press the piston 22.

Furthermore, the hammer assembly 5 further includes a hammer latch 53 and a fourth restoring spring 54. The hammer latch 53 is pivotally attached to the gun body 1 and is able to block the hammer 51. The fourth restoring spring 54 is clamped between the gun body 1 and the hammer latch 53, and drives the hammer latch 53 to restore toward a position for blocking the hammer 51.

As shown in FIG. 1 and FIG. 3 to FIG. 8, the toy gun 10 of the present disclosure further includes a trigger assembly 6. The trigger assembly 6 is installed on the gun body 1. The trigger assembly 6 includes a trigger 61, a firing pin 62, a fifth restoring spring 63 and a sixth restoring spring 64. The trigger 61 is exposed at the external of the gun body 1 and is pivotally attached to the gun body 1. The firing pin 62 is received at the internal of the gun body 1 and is pivotally attached to the gun body 1. The firing pin 62 abuts against the trigger 61 and is configured to be pressed by the hammer 51 for striking the switch valve 4. The fifth restoring spring 63 is clamped between the gun body 1 and trigger 61. The sixth restoring spring 61 is clamped between the gun body 1 and the firing pin 62, and drives the firing pin 62 and the switch valve 4 to be dislocated.

Figure 3:
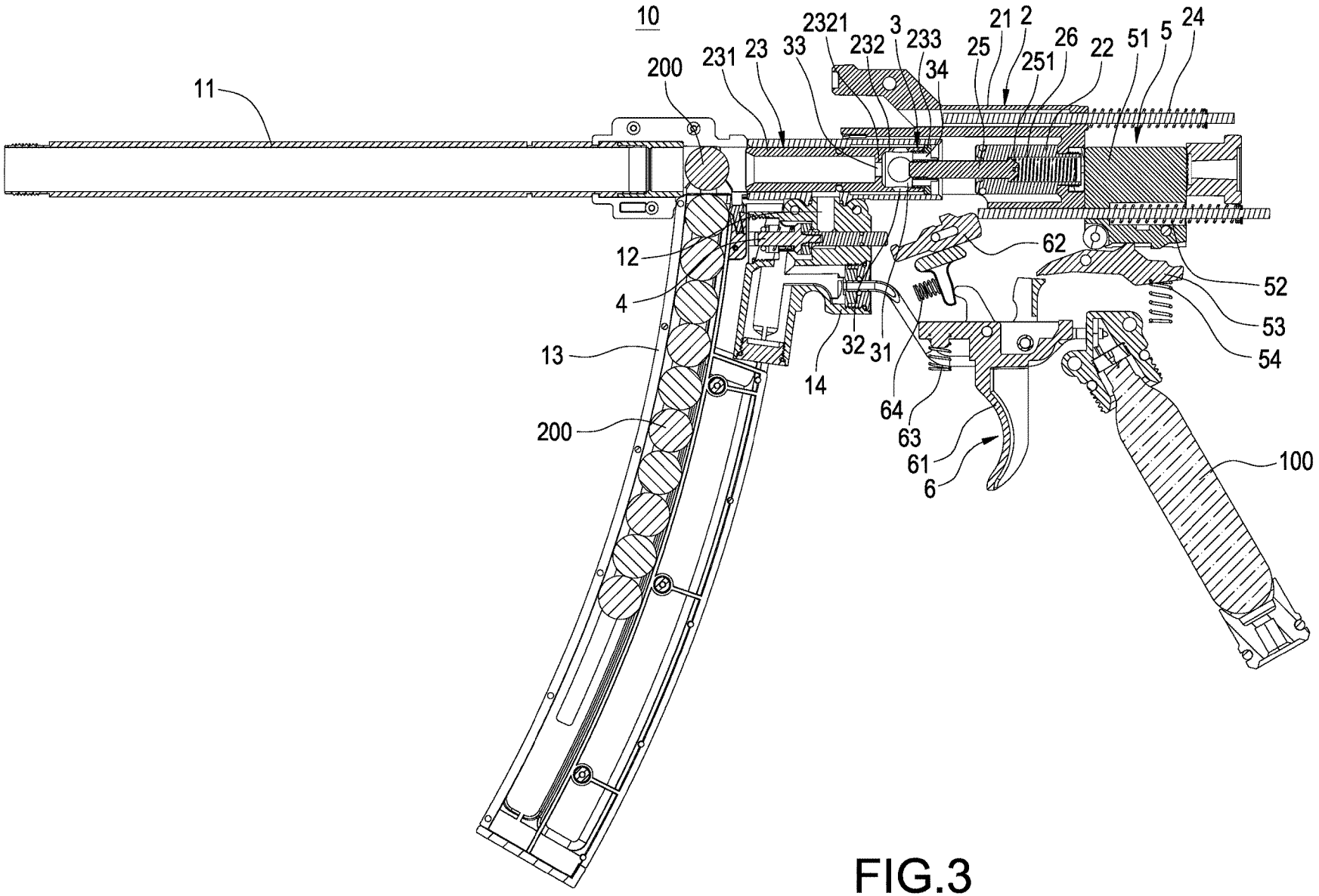
FIG. 3 is a first use state view of the toy gun of the present disclosure.

FIG. 3 to FIG. 8 are schematic views showing the state of use of the toy gun 10 of the present disclosure. First, as shown in FIG. 3, when the user pulls the action 21 in the direction away from the barrel 11, the action 21 is able to drive the piston 22 to push the hammer 51 to move rightward to the end, and during the same time, the trigger 21 also drives the bullet feeding tube 23 to move away from the barrel 11 via the piston 22 and the connecting shaft 25, allowing the bullet 200 to enter the area between the barrel 11 and the magazine 13 from the magazine 13.

Figure 4:
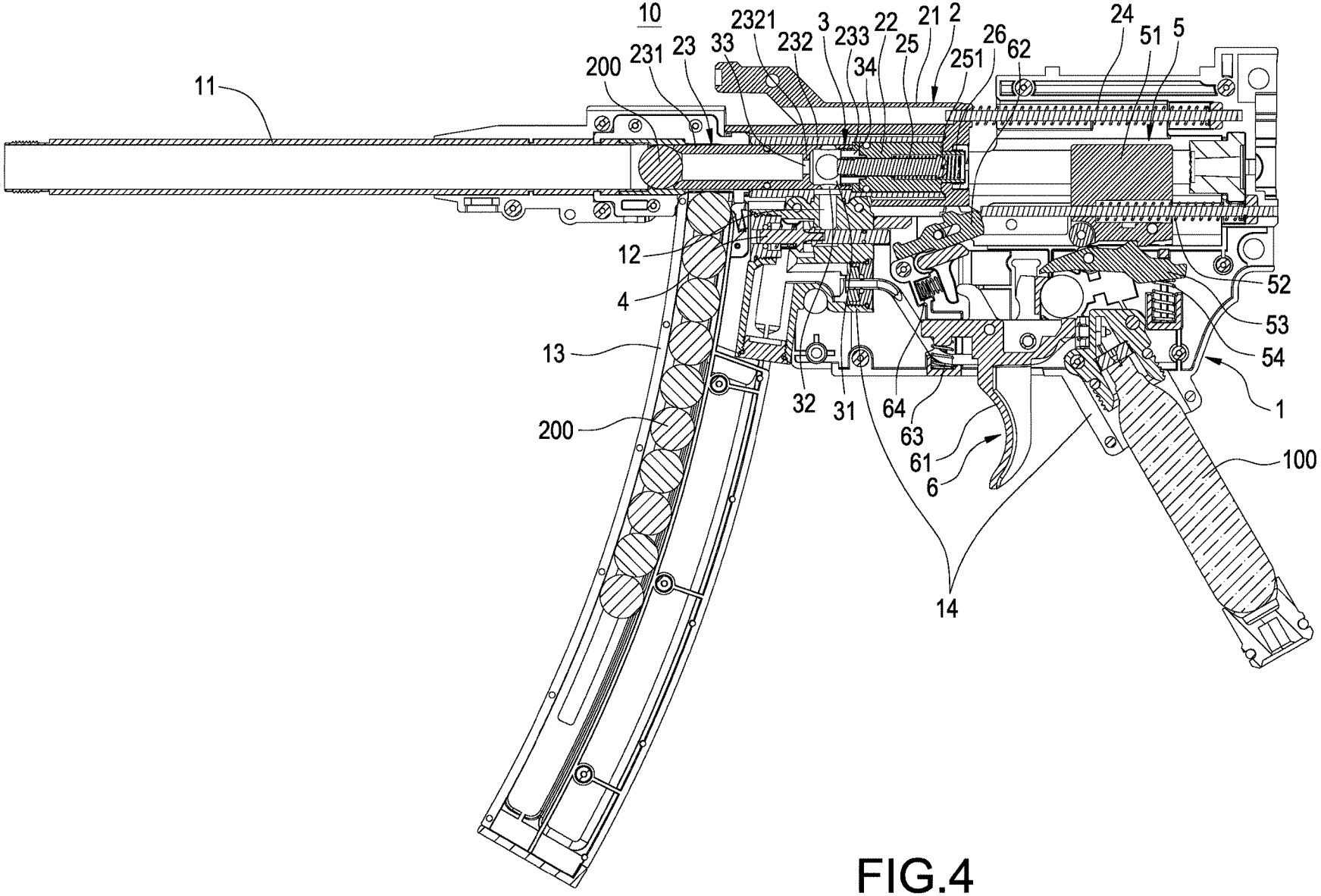
FIG. 4 is a second use state view of the toy gun of the present disclosure.

Second, as shown in FIG. 4, after the user releases the action 21, the first restoring spring 24 drives the action 21 to move in the direction toward the barrel 11 and also drives the piston 22 to push the bullet feeding tube 23. The bullet feeding tube 23 then feeds the bullet 200 into the barrel 11, and during the same time, the third restoring spring 52 drives the hammer 51 to move toward the direction of the piston 22 such that the hammer 51 is blocked by the hammer latch 53 in position.

Figure 5:
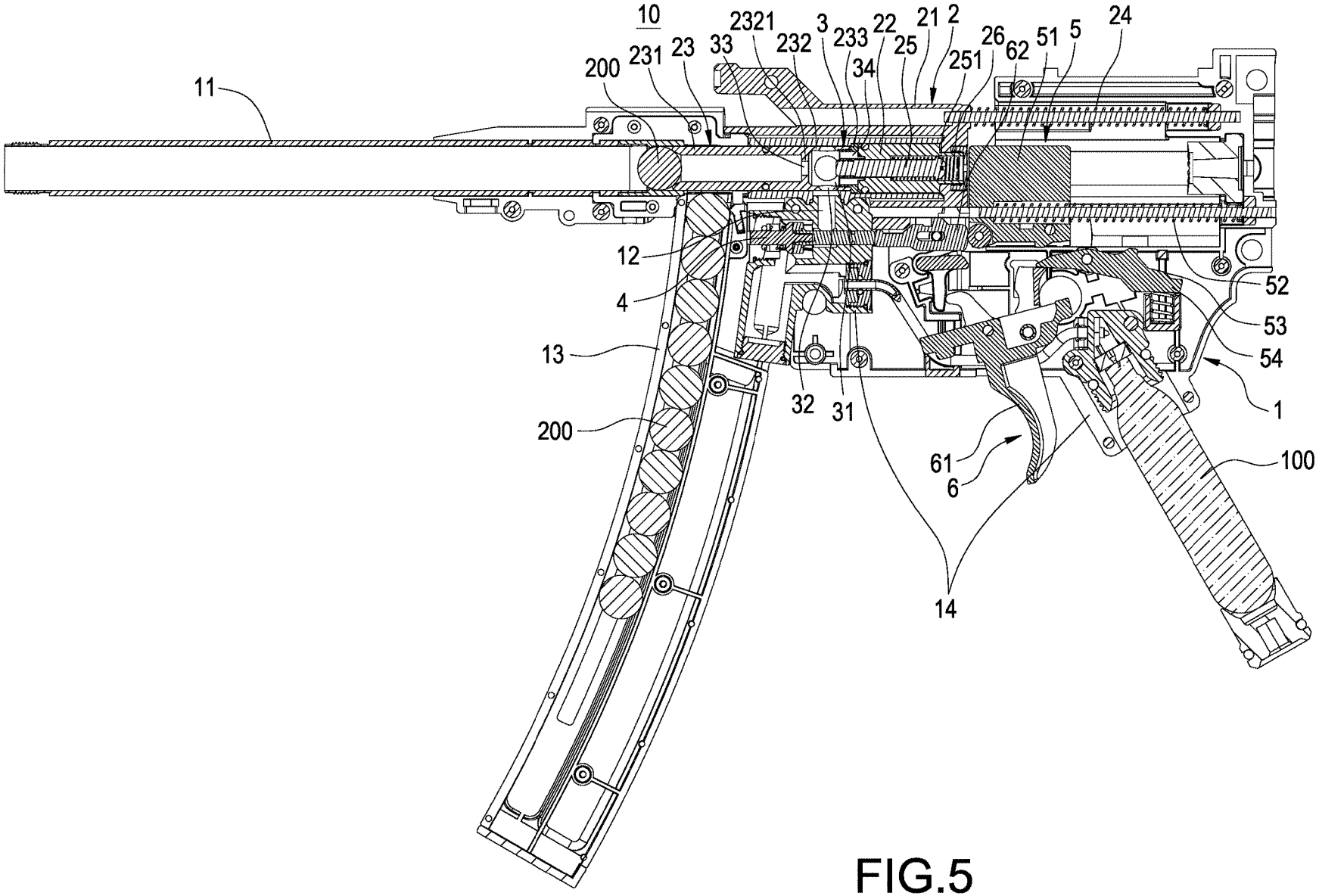
FIG. 5 is a third use state view of the toy gun of the present disclosure.

Third, as show in FIG. 5, when the user presses the trigger 61, the trigger 61 abuts against the firing pin 62 such that the firing pin 62 is in the horizontal state, and during the same time, the trigger 61 also pushes the hammer latch 53 away to release the hammer 51. Next, the hammer 51 is driven by the third restoring spring 52 to move in the direction toward the piston 22 and to strike the switch valve 4.

Figure 6:
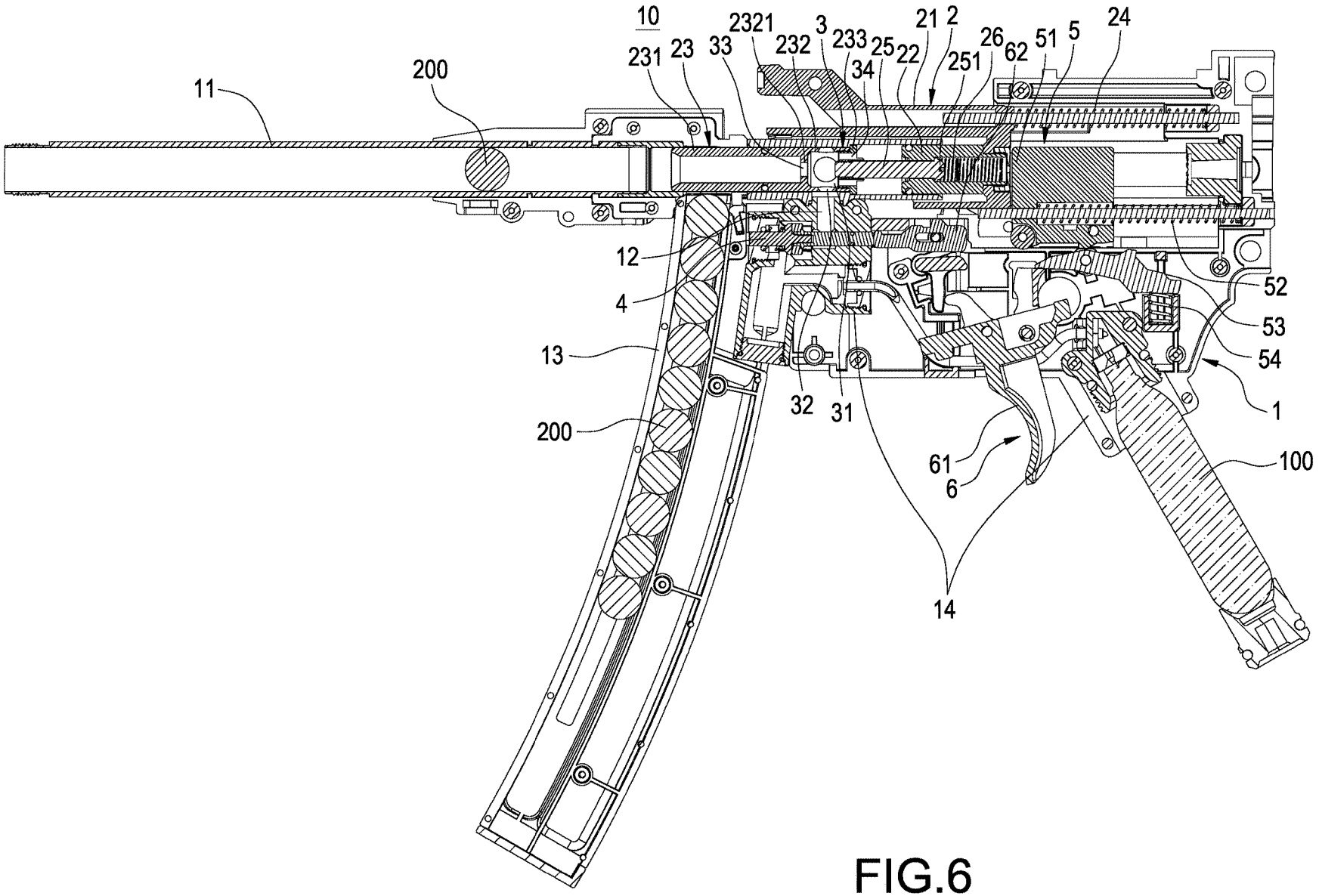
FIG. 6 is a fourth use state view of the toy gun of the present disclosure.

Fourth, as shown in FIG. 6, when the switch valve 4 is struck, the air chamber 14 is opened, and the gas of the gas cylinder 100 flows into the gas collection cavity 31 of the pressure diverter 3 via the gas chamber 14 and the gas flow conduit 12. Next, a portion of the gas flows to the barrel 11 via the first outlet hole 33 to push and fire the bullet 200. In addition, another portion of the gas flows to the piston 22 via the second outlet hole 34 to push the piston 22, the action 21 and the hammer 51 to move in the direction away from the barrel 11.

Figure 7:
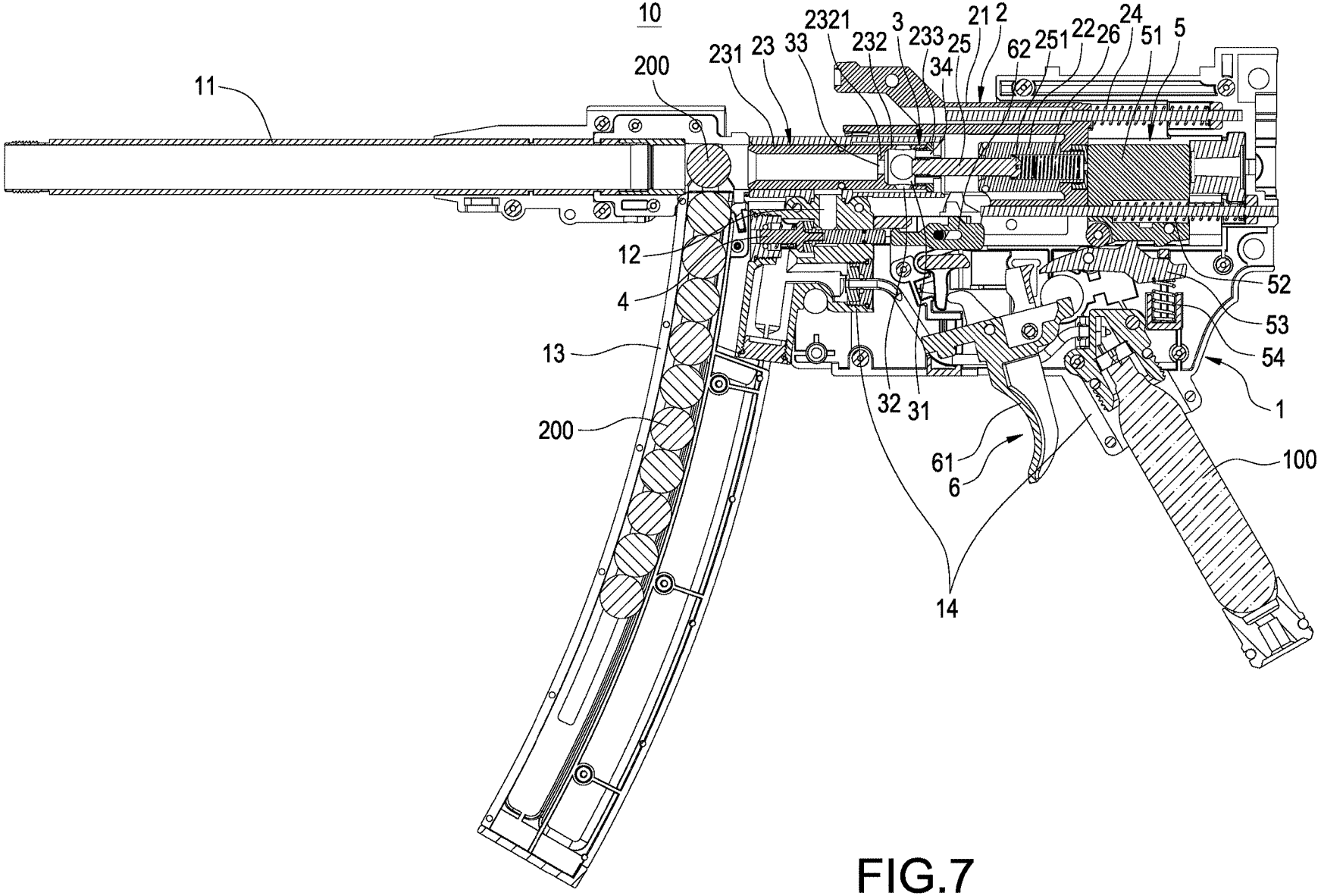
FIG. 7 is a fifth use state view of the toy gun of the present disclosure.

Fifth, as shown in FIG. 7, when the action 21 moves in the direction away from the barrel 11, it is able to drive the bullet feeding tube 23 to move away from the barrel 11, allowing the bullet 200 to enter the area between the barrel 11 and the magazine 13. When the hammer 51 moves in the direction away from the barrel 11, the firing pin 62 is released, and the sixth restoring spring 64 is able to drive the firing pin 62 and the switch valve 4 to be dislocated, and the switch valve 4 closes the gas chamber 14.

Figure 8:
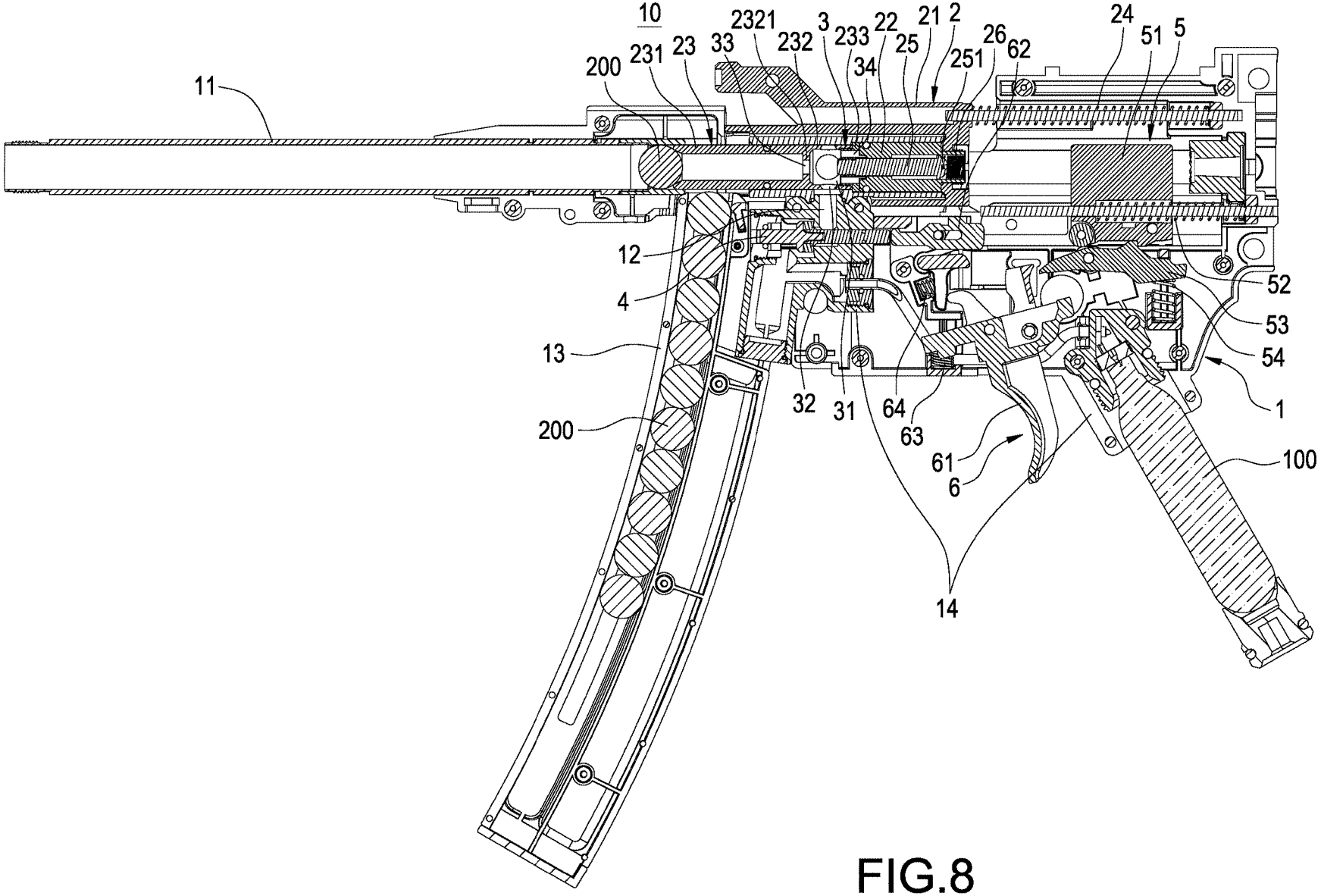
FIG. 8 is a sixth use state view of the toy gun of the present disclosure.

Sixth, as shown in FIG. 8, after the gas chamber 14 is closed, the gas no longer flows into the piston 22 via the second outlet hole 34, and the first restoring spring 24 is able to drive the action 21 to move in the direction toward the barrel 11 and is also able to drive to the piston 22 to push the bullet feeding tube 23. The bullet feeding tube 23 then feeds the bullet 200 into the barrel 11, and during the same time, the third restoring spring 52 drives the hammer 51 to move toward the direction of the piston 22 such that the hammer 51 is blocked by the hammer latch 53 in position. As the aforementioned steps are performed in cycle, it is able to complete continuous firing of shots.

Accordingly, the present disclosure uses the pressure diverter 3 to replace the known gas diverter valve. Since the pressure diverter 3 only uses the first outlet hole 33 and the second outlet hole 34 for divergence, such that the pressure diverter is able to achieve the merits of easy control of gas flow, less consumption of pressure, simple structure, facilitated assembly and low cost.

In addition, as the cross-sectional area of the first outlet hole 33 is greater than the cross-sectional area of the second outlet hole 34, it is able to control the outlet volume flowing to the barrel 11 to be greater than the outlet volume flowing to the piston 22. Accordingly, most of the gas volume may be used for firing the bullet 200 to achieve the advantageous effect of excellent gas flow divergence via the pressure diverter 3.

In view of the above, the toy gun with a pressure diverter of the present disclosure is able to achieve the expected purpose of use and to overcome known drawbacks.

What is claimed is:

1. A toy gun, comprising:

a gun body, comprising a barrel and a gas flow conduit arranged inside;

an action assembly, installed on the gun body and comprising a piston; and a pressure diverter, received in the gun body and arranged between the barrel, the gas flow conduit and the piston, the pressure diverter comprising a gas collection cavity and an inlet hole, a first outlet hole and at least one second outlet hole communicating with the gas collection cavity, the inlet hole arranged corresponding to the gas flow conduit, the first outlet hole arranged corresponding to the barrel, the at least one second outlet hole arranged corresponding to the piston, and a cross sectional area of the first outlet hole being greater than a cross sectional area of the at least one second outlet hole.

2. The toy gun according to claim 1, wherein the gun body further comprises a magazine communicating to the barrel, the action assembly further comprises a bullet feeding tube, the bullet feeding tube abuts against one end of the barrel and is arranged between the barrel and the magazine.

3. The toy gun according to claim 2, wherein the pressure diverter is attached to the bullet feeding tube, the bullet feeding tube is a hollow tubular member, the pressure diverter comprises an extension tube extended from one end of the hollow tubular member away from the barrel and a sealing cap covering and sealing the extension tube, an isolation plate is extended from an intersection between an inner wall of the extension tube and the hollow tubular member, the inlet hole is defined on the extension tube, the first outlet hole is defined on the isolation plate, and the at least one second outlet hole is defined on the sealing cap.

4. The toy gun according to claim 3, wherein the action assembly further comprises an action and a first restoring spring, the action is exposed from the gun body and configured to move horizontally forward and backward relative to the barrel, the piston is received in the gun body and secured to the action, the first restoring spring is clamped between the gun body and the action and configured to drive the action to restore in a direction away from the barrel.

5. The toy gun according to claim 4, wherein the action assembly further comprises a connecting shaft and a second restoring spring, one end of the connecting shaft is secured to outside of the sealing cap and another end of the connecting shaft movably penetrates into the piston, the connecting shaft comprises a blocker extended from the another end and mutually blocking with the piston, and the second restoring spring is clamped between the piston and the connecting shaft.

6. The toy gun according to claim 5, wherein the connecting shaft is located at a middle portion of the sealing cap, a quantity of the second outlet hole is multiple, the second outlet holes are circumferentially and equidistantly arranged at a perimeter of the connecting shaft, a cross sectional area of the first outlet hole is greater than a sum of cross-sectional areas of the plurality of second outlet holes.

7. The toy gun according to claim 1, further comprising: a switch valve, the gun body further comprising a gas chamber communicating with the gas flow conduit, and the switch valve installed between the gas flow conduit and the gas chamber.

8. The toy gun according to claim 7, further comprising: a hammer assembly received in the gun body, and comprising a hammer and a third restoring spring, the hammer arranged corresponding to the piston and configured to move horizontally forward and backward relative to the piston, and the third restoring spring clamped between the gun body and the hammer and configured to drive the hammer to press the piston.

9. The toy gun according to claim 8, wherein the hammer assembly further comprises a hammer latch and a fourth restoring spring, the hammer latch is pivotally attached to the gun body and configured to block the hammer, the fourth restoring spring is clamped between the gun body and the hammer latch and configured to drive the hammer latch to restore toward a position for blocking the hammer.

10. The toy gun according to claim 8, further comprising: a trigger assembly installed on the gun body and comprising a trigger, a firing pin, a fifth restoring spring and a sixth restoring spring, the trigger exposed from the gun body and pivotally attached to the gun body, the firing pin received in the gun body and pivotally attached to the gun body, the firing pin abutting against the trigger and configured to be pressed by the hammer to strike the switch valve, the fifth restoring spring clamped between the gun body and trigger, the six restoring spring clamped between the gun body and the firing pin and configured to drive the firing pin and the switch valve to be dislocated.

* * * * *